US006431692B1

(12) United States Patent
Thielman et al.

(10) Patent No.: US 6,431,692 B1
(45) Date of Patent: Aug. 13, 2002

(54) PACKAGED INK SUPPLY AND METHOD OF PACKAGING AN INK SUPPLY TO MAINTAIN INK IN A DEGASSED STATE

(75) Inventors: Jeffrey L. Thielman, St. Corvallis; Rhonda L. Wilson, Monmouth; Mark A. DeVries, Albany, all of OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/861,107

(22) Filed: May 18, 2001

(51) Int. Cl.[7] ..... B41J 2/175
(52) U.S. Cl. ..... 347/84; 347/86
(58) Field of Search ..... 347/84, 85, 86, 347/87

(56) References Cited

U.S. PATENT DOCUMENTS 6,241,348 B1 * 6/2001 Haigo ..... 347/86

FOREIGN PATENT DOCUMENTS

JP 10250111 A * 9/1998 ..... B41J/2/175

* cited by examiner

*Primary Examiner*—Anh T. N. Vo

(57) ABSTRACT

A packaged, degassed printer ink supply is provided, the ink supply including ink-containment vessel, a substantially degassed volume of ink contained within the ink-containment vessel, and a removable, sealable outer protective container having a low permeability to air and surrounding at least part of the ink-containment vessel to define an atmosphere between the ink-containment vessel and the outer protective container. The atmosphere between the ink-containment vessel and outer protective container is modified relative to ambient atmosphere outside of the outer protective container to decrease a diffusion rate of at least one component gas of air into the ink-containment vessel.

22 Claims, 3 Drawing Sheets

PACKAGED INK SUPPLY AND METHOD OF PACKAGING AN INK SUPPLY TO MAINTAIN INK IN A DEGASSED STATE

TECHNICAL FIELD

The present invention relates generally to packaging of ink supplies. More particularly, the invention relates to a degassed ink supply and a method of packaging an ink supply to maintain the ink in a degassed state.

BACKGROUND OF THE INVENTION

In contrast to other types of printers, inkjet printers provide fast, high resolution, black-and-white and color printing on a wide variety of media, and at a relatively low cost. As a result, inkjet printers have become one of the most popular types of printers for both consumer and business applications. Nevertheless, inkjet technology must continuously advance to keep pace with ever-increasing customer demands for printers that print faster, at a higher resolution, and at a lower cost.

One of the more important components of an inkjet printer is the inkjet printhead, which controls the application of ink to the printing medium (e.g., paper). Generally, an inkjet printhead includes a plurality of ink ejection mechanisms formed on a substrate. Each ink ejection mechanism includes a firing chamber with at least one ejection orifice. Each ink ejection mechanism also includes one or more firing resistors located in the firing chamber. The substrate is connected to an ink cartridge or other ink supply. Channel structures formed on the substrate direct the ink from the ink supply to the firing chambers. Control circuitry, located on the substrate and/or remote from the substrate, supplies current to the firing resistors in selected firing chambers. The ink within the selected chambers is super-heated by the firing resistors, causing the ink in close proximity to the resistors to be vaporized. This forms a bubble that pushes ink through the chamber orifice toward the printing medium in the form of an ink droplet.

Due to the many processing steps required to create the various printhead structures on the substrate, the printhead is typically one of the most expensive parts of an inkjet ink delivery system. Furthermore, the cost of the printhead tends to increase with the size of the printhead. For smaller printers, the cost of the printhead may be low enough to allow the use of an integrated ink supply system, in which the printhead is permanently attached to the ink supply. This arrangement necessitates replacing the printhead whenever the ink supply is replaced. Larger printers, however, often use a separate ink supply system, in which the printhead is a separate component from the ink supply. In this arrangement, the ink supply may be replaced without having to replace the printhead, thus significantly cutting the cost of new ink supplies.

Although the printhead of a separate ink supply system does not need to be changed with each change of the ink supply, it does periodically require replacement. One of the most common causes of printhead failure is the accumulation of excess air in the printhead. Excess air in the printhead can cause the printhead to fail in several different ways. For example, air that accumulates in the printhead can expand with increases in temperature or altitude, causing ink either to seep out of firing chambers. One of the most common sources of air that accumulates in the printhead is air exsolved in the ink, which can be evolved from the ink by the elevated temperatures commonly found in the printhead due to heat dissipated by the firing resistors.

Various solutions have been proposed to overcome the effects of air on the lifetime of inkjet printheads. One effective solution is to print with degassed ink, as described in U.S. patent application Ser. No. 08/758,744, entitled "Ink Supply With Air Diffusion Barrier for Unsaturated Ink," filed Jan. 11, 2001. The subject matter of that application is incorporated herein by this reference.

Degassed ink is ink that has a low concentration of dissolved gases, typically 80% or less of total saturation. When this ink reaches the printhead, it dissolves some air present in the printhead, and thus helps remove air from the printhead. The use of degassed ink may increase printhead life up to 10 times or more compared to the use of non-degassed ink. However, if air diffuses back into a degassed ink supply between manufacturing and use, such as while the ink supply is in storage, the level of saturation will increase. To address this problem, degassed ink may be contained within a relatively impermeable metalized membrane inside of the ink cartridge. However, even this type of packaging system may have portions of higher permeability to air, such as a port or septum through which ink flows out of the membrane. Because of problems with air re-saturation, degassed ink supplies tend to have a relatively short shelf life, creating problems with shipping and storing the supplies.

SUMMARY OF THE INVENTION

The present invention provides a packaged, degassed ink supply for use in a printer, and provides a method of packaging an ink supply to maintain ink in a degassed state. The packaged ink supply includes an ink-containment vessel, a substantially degassed volume of ink contained within the ink-containment vessel, and a removable, sealable outer protective container having a low permeability to air and surrounding at least part of the ink-containment vessel to define an atmosphere between the ink-containment vessel and the outer protective container. The atmosphere between the ink-containment vessel and outer protective container is modified relative to ambient atmosphere outside of the outer protective container to decrease a diffusion rate of at least one component gas of air into the ink-containment vessel.

DETAILED DESCRIPTION OF THE PREFERRED EMBODIMENTS

Figure 1:
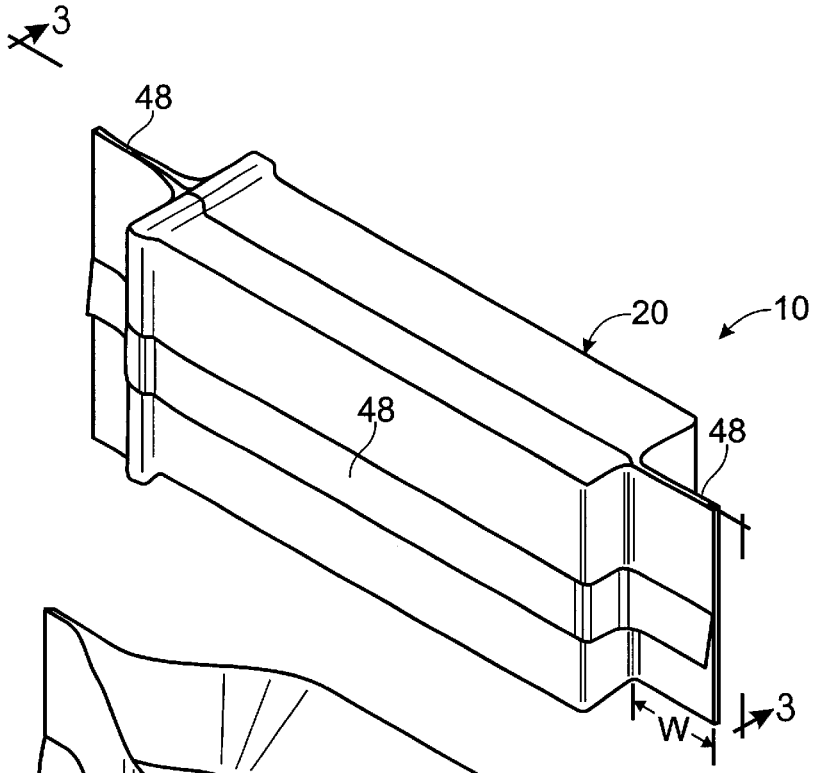
FIG. 1 is an isometric view of a packaged ink supply constructed in accordance with the present invention.
Figure 2:
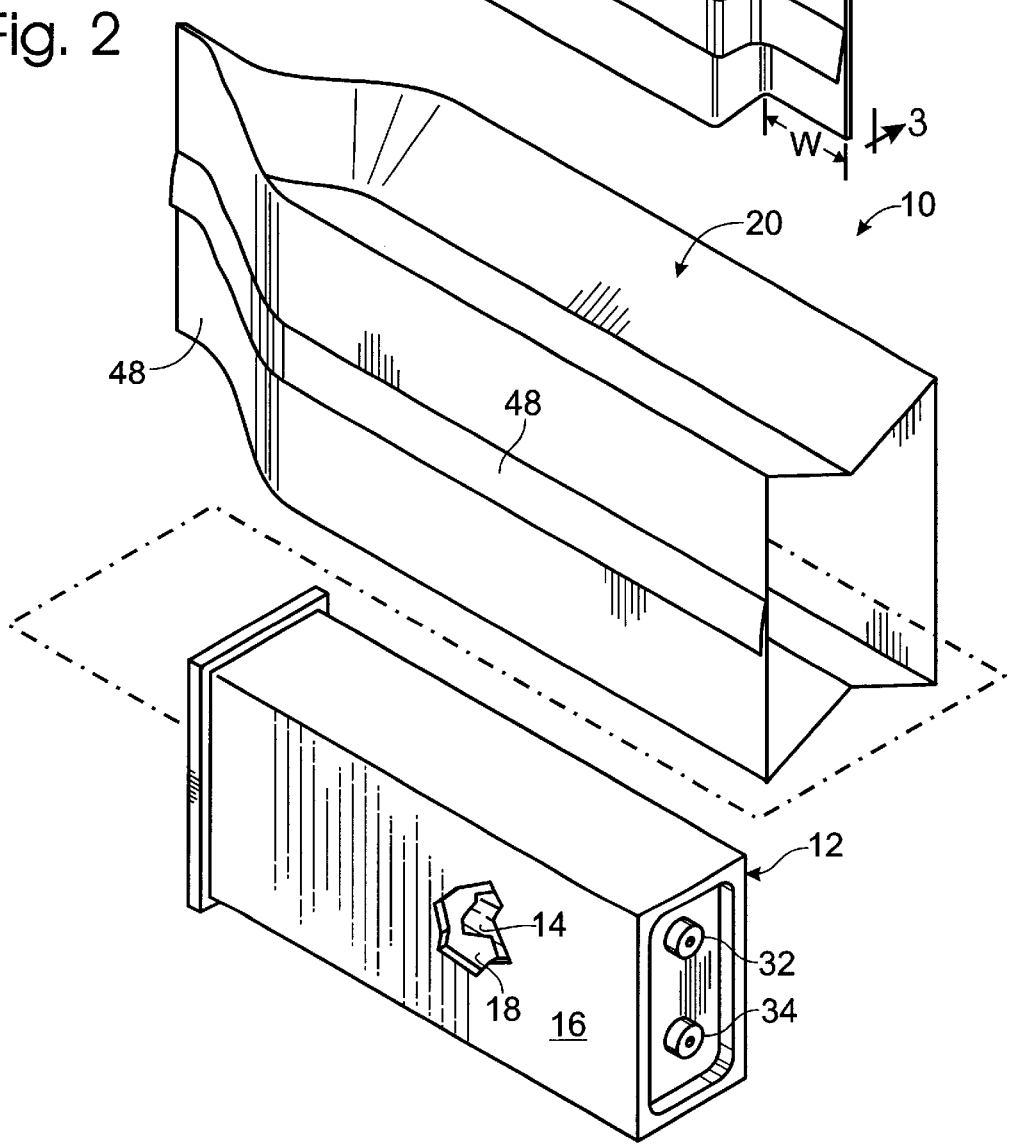
FIG. 2 is an exploded isometric view of the ink supply and ink supply packaging of FIG. 1.
Figure 3:
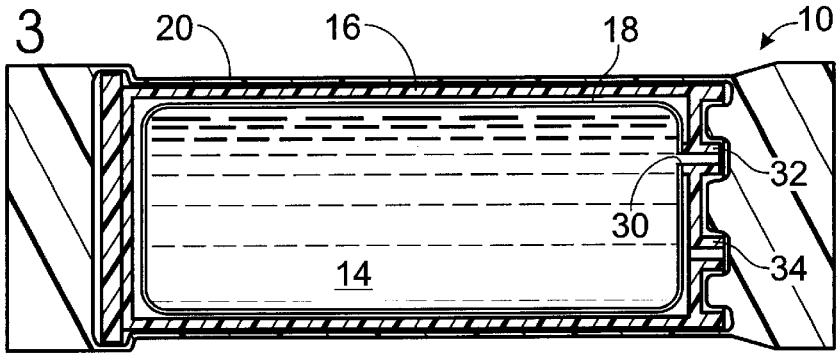
FIG. 3 is a sectional view of the packaged ink supply of FIG. 1 taken along lines 3—3 of FIG. 1.

A first embodiment of a packaged, degassed ink supply according to the present invention is depicted generally at 10 in FIGS. 1–3. Ink supply 10 includes an ink-containment vessel 12 that houses a volume of degassed ink 14. The depicted ink-containment vessel 12 includes a generally rigid outer housing 16 and an inner membrane 18 that contains degassed ink 14. It will be appreciated, however, that any other suitable ink-containment vessel may be used. Packaged ink supply 10 also includes packaging in the form of a removable, outer protective container 20. Outer protective container 20 is made from a material with a low permeability to air, and is configured to surround any parts of ink-containment vessel 12 that have an unsuitably high permeability to air. Typically, as shown in FIGS. 2 and 3, outer protective container 20 is configured to completely envelop ink-containment vessel 12.

In accordance with the present invention, the atmosphere within the space between ink-containment vessel 12 and outer protective container 20 is modified relative to the atmosphere outside of the protective container to modify the diffusion gradient of at least one component gas of air across ink-containment vessel 12, and thus to change the rate of diffusion of the gas either into or out of degassed ink 14. Typically, this is accomplished by sealing the outer protective container about the ink-containment vessel and creating at least a partial vacuum within the outer protective container as will be described further below.

To extend the life of an inkjet printhead, it may be desirable to maintain a low concentration of all dissolved gases in degassed ink 14. Thus, the atmosphere between ink-containment vessel 12 and outer protective container 20 may be modified in a way to decrease diffusion of all component gases of air across ink-containment vessel 12 and into degassed ink 14. This may be accomplished by partially evacuating the space between ink-containment vessel 12 and outer protective container 20. The transmission rate of a gas through a medium is given by the equation:

$$T_x = P_x A p_x / t \quad (1)$$

where $T_x$ is the transmission rate for gas x, $P_x$ is the permeability of the medium to gas x, A is the area of the medium exposed to gas x, $P_x$ is the partial pressure of gas x against the medium, and t is the thickness of the medium.

As is evident from this equation, the transmission rate of each component gas of air into degassed ink 14 is directly proportional to the partial pressure of that gas in the space between ink-containment vessel 12 and outer protective container 20. Thus, by lowering the total gas pressure between ink-containment vessel 12 in this space, the transmission rates of all component gases of air through ink-containment vessel 12 are lowered.

The space between ink-containment vessel 12 and outer protective container 20 may be evacuated to any desired pressure. The desired pressure will generally depend upon the permeability of the material from which outer protective container 20 is made, as well as other factors, such as the cost of vacuum packaging to a desired pressure. Typically, the pressure will be in the range of 0.1–0.6 atmospheres, and more typically approximately 0.5 atmospheres, though either higher or lower pressures may be used. Furthermore, while the atmosphere between ink-containment vessel 12 and outer protective container 20, as described herein, has been modified by partial evacuation, it will be appreciated that it can be modified in other ways. For example, the atmosphere in the space between ink-containment vessel 12 and outer protective container 20 may be modified by purging the atmosphere with a gas that has a low transmission rate across ink-containment vessel 12.

After modifying the atmosphere between ink-containment vessel 12 and outer protective container 20, the outer protective container is sealed to maintain the modified atmosphere in the area surrounding the ink-containment vessel. Outer protective container 20 may be sealed in any suitable manner that provides an acceptably low rate of diffusion of air into the outer protective container. For example, a chemical adhesive, such as an epoxy with a low permeability to air, may be used to close outer protective container 20. In the depicted embodiment, however, outer protective container 20 is made at least partially of a material that can be bonded to itself to form a seal, for example via heat fusion, as described in more detail below.

Outer protective container 20 may be configured to cover as much of ink-containment vessel 12 as desired. As mentioned above, ink-containment vessel 12 may have some regions of relatively higher permeability to air than other regions. Therefore, it is generally desirable for outer protective container 20 to cover at least these regions. For example, in the depicted embodiment, degassed ink 14 is mostly surrounded by inner membrane 18. Inner membrane 18 is typically made of a material that is relatively impermeable to air, such as a film containing a metal or metalized foil. Because inner membrane 18 has a low permeability to air, little air diffuses into degassed ink 14 through the inner membrane, even though a relatively large quantity of air may be present between housing 16 (which is typically made of a lower barrier material such as polyethylene) and the inner membrane.

However, as best seen in FIG. 3, inner membrane 18 does have an opening 30 that allows ink to flow out of ink-containment vessel 12. This opening extends through a first septum 32 in housing 16. First septum 32 typically is made of an elastomeric or plastic material which may have a higher permeability to air than the metalized foil of inner membrane 18. Thus, first septum 32 may present a more rapid path for diffusion of air into degassed ink 14 than the other parts of ink-containment vessel 12. Therefore, it is desirable for outer protective container 20 to cover first septum 32. Similarly, a second septum 34 may be disposed on housing 16 to allow air to be pumped into the area between housing 16 and inner membrane 18 to force ink out of first septum 32. Second septum 34 also typically is made of an elastomeric or plastic material which may have a higher permeability to air than the metalized foil of inner membrane 18. Accordingly, second septum 34 also may present a more rapid path for diffusion of air into degassed ink 14 than the parts of ink-containment vessel 12. Therefore, it is desirable for outer protective container 20 to cover second septum 34.

More often, ink-containment vessel 12 will be completely within outer protective container 20, as shown in the depicted embodiment. This is advantageous where housing 16 is made of a relatively permeable material, such as polyethylene, in order to prevent air from diffusing through exposed portions of housing 16 and into the space between ink-containment vessel 12 and outer protective container 20. On the other hand, if housing 20 is made of a relatively impermeable material, it may be desirable to cover only the portion of ink-containment vessel 12 surrounding first septum 32, rather than the entire ink-containment vessel.

Outer protective container 20 may have any suitable design that presents an adequate diffusion barrier to outside air. For example, a rigid enclosure made of a low permeability plastic may be used. In the depicted embodiment, however, outer protective container 20 takes the form of a flexible bag of a sufficient size to enclose ink-containment vessel 12 fully. This flexible bag may be made of any suitable material.

Figure 4:
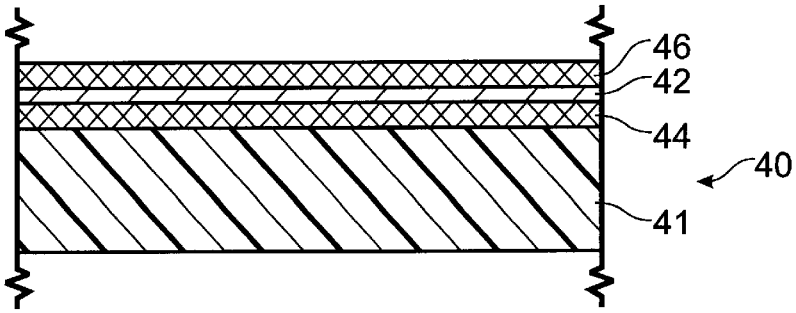
FIG. 4 is an enlarged sectional view of a first material suitable for use in constructing the packaging of the packaged ink supply of FIG. 1.
Figure 5:
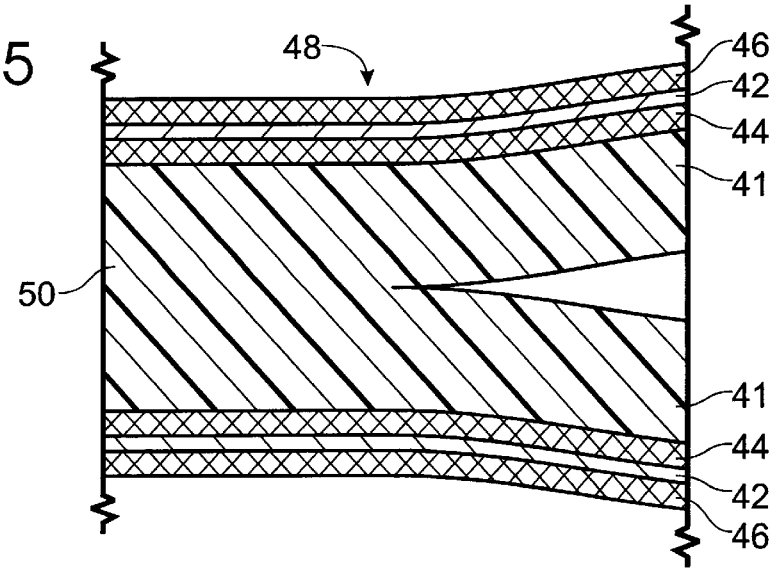
FIG. 5 is an enlarged sectional view showing a seam of the packaging of the packaged ink supply of FIG. 1.

FIG. 4 shows generally, at 40, an enlarged sectional view of one suitable layered material for use in formation of outer protective container 20. Layered material 40 includes a bondable layer 41 for sealing protective container 20, and a barrier layer 42 which has a relatively low permeability to air.

An intermediate layer 44 may be positioned between bondable layer 41 and barrier layer 42 to strengthen the adherence between bondable layer 41 and barrier layer 42. Furthermore, an outer layer 46 may be provided to protect barrier layer 42, or to allow labeling and/or instructions to be printed directly onto outer protective container 20. The use of an outer printable layer is particularly advantageous as it allows packaged ink supply 10 to be displayed and sold without the use of an outer box or an instructional insert, and thus may lower the cost of the packaged, degassed ink supply 10.

Intermediate layer 44 and outer layer 46 may be made of any suitable material. An example of a suitable material is a plastic, typically a polyamide or polyester such as polyethylene terephthalate. Each of these layers is generally approximately 8–16 micrometers thick, and more typically about 12 micrometers thick, but either layer may have a thickness outside of this range In one typical embodiment, such as that shown in FIG. 4, intermediate layer 44 is formed of a polyamide, and outer printable layer 46 is formed of a polyester such as polyethylene terephthalate.

Bondable layer 41 may be made of any suitable material but typically is made from a material that may be fused to itself with heat. An example of one such material is polyethylene. Bondable layer 41 may also have any desired thickness. It may be advantageous, however, to use a relatively thin bondable layer to decrease the spacing of the barrier layers 42 in seam 48. This decreases the thickness of the fused layer 50 of seam 48 through which air can diffuse, and thus also decreases the diffusion rate of air through seam 48. Bondable layer 41 is typically 50–100 micrometers thick, and more typically approximately 75 micrometers thick. The thickness of fused layer 50 may be somewhat less than double the thickness of bondable layer 41, as some thickness may be lost in the fusion process. Similarly, the seam may be made any width W. The thicker the seam, the lower the diffusion rate of air through the seam. Typically, seam 48 will be from 0.5–2 cm wide, and more typically approximately 0.8 cm wide, though it may also have a width outside of this range.

Bondable layer 41 may be made of any suitable material but typically is made from a material that may be fused to itself with heat. An example of one such material is polyethylene. Bondable layer 41 may also have any desired thickness. It may be advantageous, however, to use a relatively thin bondable layer to decrease the spacing of the barrier layers 42 in seam 48. This decreases the thickness of the fused layer 50 of seam 48 through which air can diffuse, and thus also decreases the diffusion rate of air through seam 48. Bondable layer 41 is typically 50–100 microns thick, and more typically approximately 75 microns thick. The thickness of fused layer 50 may be somewhat less than double the thickness of bondable layer 41, as some thickness may be lost in the fusion process. Similarly, the seam may be made any width W. The thicker the seam, the lower the diffusion rate of air through the seam. Typically, seam 48 will be from 0.5–2 cm wide, and more typically approximately 0.8 cm wide, though it may also have a width outside of this range.

As with bondable layer 41, barrier layer 42 may be positioned in any desired layer of outer protective container 20. In the layered material depicted in FIG. 4, barrier layer 42 is positioned between intermediate layer 44 and outer printable layer 46. Additionally, barrier layer 42 may be made of any suitable material with desired permeability characteristics. An example of a suitable material is a metal foil, such as aluminum foil. It will be appreciated, however, that high barrier plastics, such as polyvinylidene chloride or ethylene vinyl alcohol, may also be used. The barrier layer also may take the form of a film of aluminum or aluminum oxide deposited on a layer of polyethylene terephthalate. The thickness of barrier layer 42 may be selected to give outer protective container 20 desired diffusion characteristics.

Generally, it is desirable for outer protective container 20 to allow less than about 1.5 $cm^3$/year of air to diffuse therethrough. Aluminum has a very low permeability to the component gases of air, and thus may be used in a very thin layer. Typically, an aluminum barrier layer 42 will have a thickness of 6–10 micrometers, although a barrier layer with a thickness outside this range may also be used. A thin aluminum barrier layer, however, will accommodate a flexible multilayer outer protective container as described herein.

Figure 6:
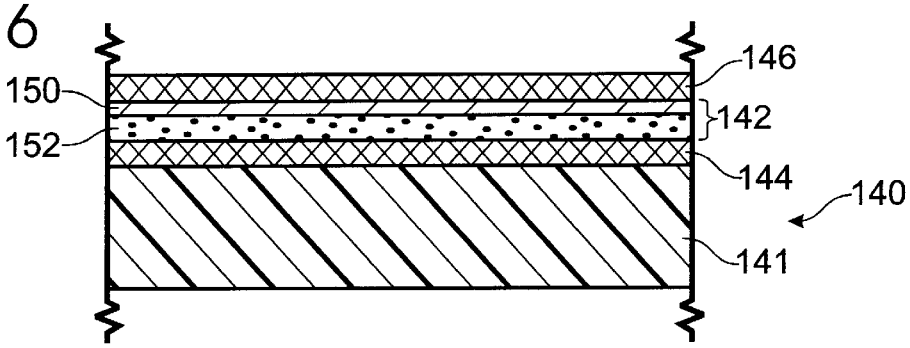
FIG. 6 is an enlarged sectional view of a second material suitable for use in constructing the packaging of the packaged ink supply of FIG. 1.

FIG. 6 shows generally at 140 an enlarged sectional view of a second layered material suitable for use as outer protective container 20. Like layered material 40, layered material 140 includes a bondable layer 141, a barrier layer 142, an intermediate layer 144 and an outer layer 146. However, barrier layer 142 itself is a multilayer structure formed from a barrier film 150 of a material with suitably low permeability deposited upon a substrate layer 152.

Barrier film 150 typically is formed from a material with a low permeability to air, such as aluminum metal or aluminum oxide. Barrier film 150 may be formed on substrate layer 152 in any desired manner, for example by evaporation or sputtering. Barrier film 150 may also have any desired thickness. Because aluminum metal has a very low permeability to air, it may be used in a very thin layer, typically only a few micrometers thick. Similarly, substrate layer 152 may be any desired material and thickness. An example of a typical substrate layer is a flexible polymeric material, such as polyethylene terephthalate (PET), with a thickness of approximately 6–10 micrometers.

Figure 7:
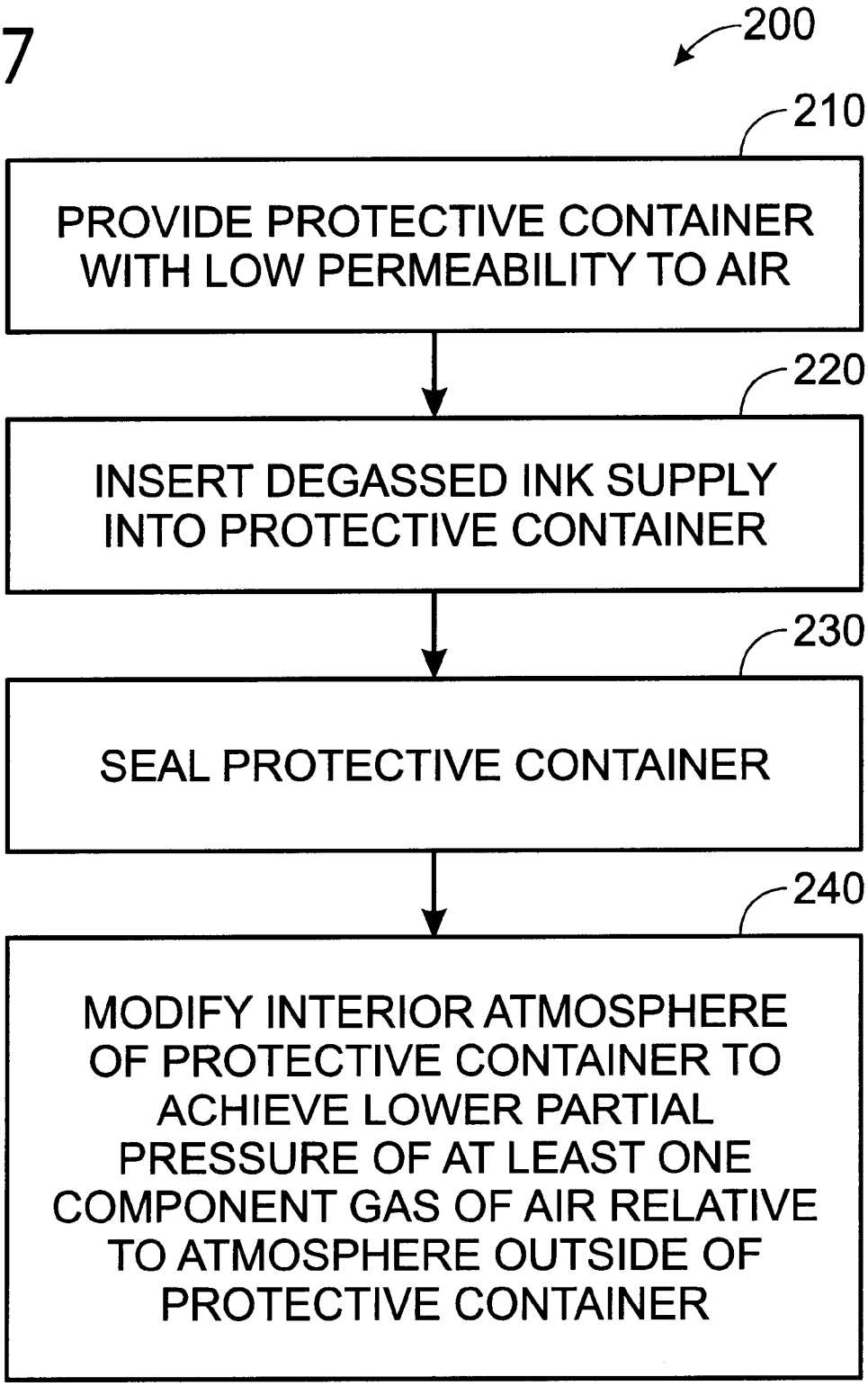
FIG. 7 is a flow diagram demonstrating a method of packaging an ink supply to maintain ink in a degassed state in accordance with the present invention.

A method of packaging an ink supply to maintain a volume of ink in a degassed state is shown generally at 200 in FIG. 7. As indicated, such method involves providing the protective container with a low permeability to air at 210, inserting a degassed ink supply into the protective container at 220, sealing the protective container at 230, and modifying the interior atmosphere of the protective container to achieve a lower partial pressure of at least one component gas of air relative to the atmosphere outside of the protective container at 240. Thus a packaged ink supply configured to maintain ink in a degassed state may be achieved.

To test the effectiveness of outer protective container herein described, an outer protective container with an 8-micrometer thick aluminum foil barrier layer was constructed to completely enclose a 780 $cm^3$ ink-containment vessel. An ink-containment vessel with 780 $cm^3$ of ink can hold approximately 20 $cm^3$ of air at room temperature when fully saturated. The space between the ink-containment vessel and the outer protective container, which had a volume of approximately 100 $cm^3$, was pumped down to approximately 0.5 atmospheres. Under these conditions, the outer protective container was found to pass only about 1 $cm^3$/year of air into the space between the ink-containment vessel and the outer protective container. At this diffusion rate, degassed ink contained within the ink-containment vessel will maintain an acceptably low level of air saturation for years. In contrast, the ink may last only a few months in the absence of an outer protective container with a modified atmosphere contained therein. Furthermore, when ready for use, the ink-containment vessel may simply be removed from the outer protective container by tearing, cutting or otherwise rupturing the outer protective container.

While the present invention has been particularly shown and described with reference to the foregoing depicted embodiments, those skilled in the art will understand that many variations may be made therein without departing from the spirit and scope of the invention as defined in the following claims. The description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element or the equivalent thereof, such claims should be understood to include incorporation of one or more such elements, neither requiring nor excluding two or more such elements.

We claim:

1. A packaged, degassed printer ink supply, comprising:

an ink-containment vessel;

a substantially degassed volume of ink contained within the ink-containment vessel; and a removable outer protective container having a low permeability to air and surrounding at least part of the ink-containment vessel to define an atmosphere between the ink-containment vessel and the outer protective container, wherein the atmosphere between the ink-containment vessel and the outer protective container is modified to have a lower partial pressure of at least one component gas relative to partial pressure of the at least one component gas in ambient air outside of the outer protective container, thereby slowing diffusion of the at least one component gas into the ink-containment vessel.

2. The ink supply of claim 1, wherein the outer protective container surrounds the entire ink-containment vessel.

3. The ink supply of claim 1, wherein the atmosphere between the ink-containment vessel and the outer protective container has a lower total pressure than total ambient pressure outside of the outer protective container.

4. The ink supply of claim 3, wherein the atmosphere between the ink-containment vessel and the outer protective container is at a pressure of approximately 0.1–0.6 atmospheres.

5. The ink supply of claim 1, wherein the outer protective container is formed from a material having a plurality of layers, and wherein the plurality of layers includes a barrier layer for preventing diffusion of air through the outer protective container and a bondable layer for sealing the outer protective container around the ink-containment vessel.

6. The ink supply of claim 5, wherein the bondable layer is polyethylene.

7. The ink supply of claim 5, wherein the bondable layer is approximately 50–100 micrometers thick.

8. The ink supply of claim 5, wherein the barrier layer is aluminum foil.

9. The ink supply of claim 5, wherein the barrier layer is a film of aluminum deposited on a layer of polyethylene terephthalate.

10. The ink supply of claim 5, wherein the barrier layer is a film of aluminum oxide deposited on a layer of polyethylene terephthalate.

11. The ink supply of claim 5, wherein the barrier layer is approximately 6–10 micrometers thick.

12. The ink supply of claim 5, wherein the plurality of layers includes a printable outer layer.

13. The ink supply of claim 5, wherein the printable outer layer is approximately 8–16 micrometers thick.

14. The ink supply of claim 1, wherein the protective container is formed from a material comprising an inner layer of polyethylene, a first layer of polyamide, a barrier layer, and an outer second layer of polyester.

15. The ink supply of claim 1, wherein air diffuses through the outer protective cover at a rate of approximately 1.5 $cm^3$/year or less.

16. A method of packaging an ink supply to maintain a volume of ink in a degassed state, the method comprising:

inserting an ink-containment vessel into a protective container having a low permeability to air;

sealing the protective container; and evacuating the protective container to a sufficiently low pressure to slow diffusion of residual air contained within the container through the ink-containment vessel and into the ink.

17. The method of claim 16, wherein evacuating the interior atmosphere includes evacuating the interior atmosphere to a pressure of approximately 0.5 atmospheres.

18. The method of claim 16, the protective container including an inner bondable layer, wherein sealing the protective container includes connecting spaced-apart regions of the bondable layer.

19. The method of claim 16, wherein sealing the protective container includes sealing the protective container with heat.

20. The method of claim 16, wherein sealing the protective container includes forming a seam with a width of approximately 0.5–2.0 cm.

21. A method of decreasing a diffusion rate of at least one component gas of air into a degassed ink supply, the degassed ink supply including a housing, an ink-containment vessel disposed within the housing and a volume of degassed ink contained within the ink-containment vessel, the method comprising:

providing a sealable, protective container having a hollow interior with an interior atmosphere, the protective container being made of a material with a low permeability to air;

inserting the degassed ink supply into the interior of the protective container;

sealing the protective container to enclose the degassed ink supply within the protective container; and modifying the interior atmosphere within the protective container to create a modified atmosphere within the protective container, wherein the modified atmosphere has a lower partial pressure of the at least one component gas of air relative to the atmosphere outside of the protective container.

22. The method of claim 21, wherein modifying the interior atmosphere includes partially evacuating the interior atmosphere within the protective container.

* * * * *